US007763408B2

(12) United States Patent
Udo et al.

(10) Patent No.: US 7,763,408 B2
(45) Date of Patent: Jul. 27, 2010

(54) METHOD FOR MANUFACTURING DEVELOPING AGENT

(75) Inventors: Motonari Udo, Mishima (JP); Takashi Urabe, Sunto-gun (JP); Tsuyoshi Itou, Izunokuni (JP); Masahiro Ikuta, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 426 days.

(21) Appl. No.: 11/947,434

(22) Filed: Nov. 29, 2007

(65) Prior Publication Data

US 2008/0131809 A1 Jun. 5, 2008

Related U.S. Application Data

(60) Provisional application No. 60/868,198, filed on Dec. 1, 2006.

(30) Foreign Application Priority Data

Nov. 22, 2007 (JP) ..... 2007-303320

(51) Int. Cl.
*G03G 9/087* (2006.01)

(52) U.S. Cl. ..... 430/137.14

(58) Field of Classification Search ..... 430/137.14
See application file for complete search history.

(56) References Cited

U.S. PATENT DOCUMENTS

2007/0249791 A1* 10/2007 Udo et al. ..... 526/72

FOREIGN PATENT DOCUMENTS

JP 09-022144 1/1997
JP 2004-184719 7/2004

* cited by examiner

*Primary Examiner*—John L Goodrow
(74) *Attorney, Agent, or Firm*—Turocy & Watson, LLP

(57) ABSTRACT

A dispersion containing a coloring agent particle is mixed in a dispersion of a radical polymerizable monomer, and a reducing agent containing an iron(II) salt is added in the presence of a polymerization initiator to polymerize the dispersed radical polymerizable monomer by the action of a generated radical, thereby not only forming a binder resin fine particle but coagulating the binder resin fine particle and the coloring agent particle to form a coagulated particle.

7 Claims, 2 Drawing Sheets

METHOD FOR MANUFACTURING DEVELOPING AGENT

CROSS-REFERENCE TO RELATED APPLICATIONS

This application claims the benefit of U.S. Provisional Application No. 60/868,198, filed Dec. 1, 2006.

This application is based upon and claims the benefit of priority from prior Japanese Patent Application No. 2007-303320, filed Nov. 22, 2007, the entire contents of which are incorporated herein by reference.

BACKGROUND OF THE INVENTION

1. Field of the Invention

The present invention relates to a developing agent for developing an electrostatic charge image or a magnetic latent image in electrophotography, electrostatic printing, magnetic recording and the like.

2. Description of the Related Art

In the related-art production method of an electrophotographic toner, a kneading pulverization method was the main current. In the case of a toner particle to be produced by the kneading pulverization method, in general, its shape was amorphous, and its surface composition was heterogeneous.

In recent years, with the diffusion of a digital color system aiming at a high image quality, needs for realizing a small particle size have increased. The small-sized toner is able to increase a coverage on a medium such as paper at a low consumption amount of toner and is especially advantageous for colorization of electrophotography. Also, from the viewpoint of enhancing transfer properties and fixability, it has been demanded to precisely control a toner particle regarding the toner shape, particle size distribution and encapsulation and the like. As a production method which meets these demands, the production of a toner by a polymerization method is exemplified.

As the production of a toner by a polymerization method, there are an emulsion polymerization coagulation method, a suspension polymerization method, a solution suspension method and the like. Among these methods, in order to meet the foregoing precise control of a toner particle, an emulsion polymerization coagulation method is advantageous.

In the production method of a toner by employing an emulsion polymerization coagulation method, as a production step of a binder resin, according to the related-art method, a monomer micelle is first produced from an emulsifier, styrene, an acrylic ester, acrylic acid and pure water by using a homogenizer.

Next, pure water and an emulsifier are charged in a polymerizer and sealed with nitrogen. When the internal temperature reaches a prescribed temperature, an aqueous solution of a polymerization initiator is added, and the addition of the previously prepared monomer micelle is rapidly started. After the dropwise addition for a prescribed time, ripening is further performed for a prescribed time.

The residual initiator aqueous solution is added, and ripening is further performed for a prescribed time.

Thereafter, the thus synthesized emulsion is formed into a toner by a method of adding a surfactant in a pigment/wax mixed solution and adding a coagulating agent.

By employing this production method, in the production step of a binder resin, it is possible to reduce the residual monomer which not only imparts a monomer odor and undesirable tackiness to the binder resin but causes filming of the toner, conveyance failure and so on. However, this method took a long ripening time and was poor in efficiency. Also, this method required the new addition of a large amount of the coagulating agent and was large in an environmental load.

BRIEF SUMMARY OF THE INVENTION

Under the foregoing circumstances, the invention has been made, and an object thereof is to provide a method for producing a developing agent, which is capable of not only simplifying production steps of a developing agent but reducing a residual monomer in a binder resin.

The method for producing a developing agent according to the invention comprises a step of applying a radical polymerizable monomer as a binder resin material in a dispersion medium containing a dispersant selected from the group consisting of an anionic surfactant, a nonionic surfactant and a cationic surfactant and a polymerization initiator to prepare a dispersion of the radical polymerizable monomer; and a step of, after mixing a dispersion containing a coloring agent particle in the dispersion of the radical polymerizable monomer, adding a reducing agent selected from iron(II) sulfate and iron(II) chloride to polymerize the dispersed radical polymerizable monomer by the action of a generated radical, thereby not only forming a binder resin fine particle but coagulating the binder resin fine particle and the coloring agent particle to form a coagulated particle.

By employing the invention, it is possible to obtain a developing agent in which the residual monomer in the binder resin is sufficiently reduced through simplified steps.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A method for producing a developing agent according to the invention includes the steps of mixing a dispersion containing a coloring agent particle in a dispersion of a radical polymerizable monomer; and adding a reducing agent containing an iron(II) salt in the presence of a polymerization initiator to polymerize the dispersed radical polymerizable monomer by the action of a generated radical, thereby not only forming a binder resin fine particle but coagulating the binder resin fine particle and the coloring agent particle to form a coagulated particle.

The dispersion of a radical polymerizable monomer is prepared by adding dropwise a radical polymerizable monomer as a binder resin material in a dispersion medium.

The dispersion medium contains a dispersant selected from the group consisting of an anionic surfactant, a nonionic surfactant and a cationic surfactant and a polymerization initiator.

Iron(II) sulfate or iron(II) chloride is useful as the iron(II) salt.

According to the invention, by adding the iron(II) sulfate or iron(II) chloride reducing agent in the polymerization initiator, an oxidation reduction reaction is caused; polymerization of the radical polymerizable monomer is achieved by the action of a generated radical, whereby a binder resin fine particle is formed, but an iron ion of the reducing agent converts from a divalent iron ion ($Fe^{2+}$) into a trivalent iron ion ($Fe^{3+}$); and this trivalent iron ion acts as a coagulating agent to coagulate the formed binder resin fine particle. Thus, according to the invention, the both steps of polymerization and coagulation can be efficiently achieved within a short period of time, and the unreacted residual monomer can be reduced.

Figure 1:
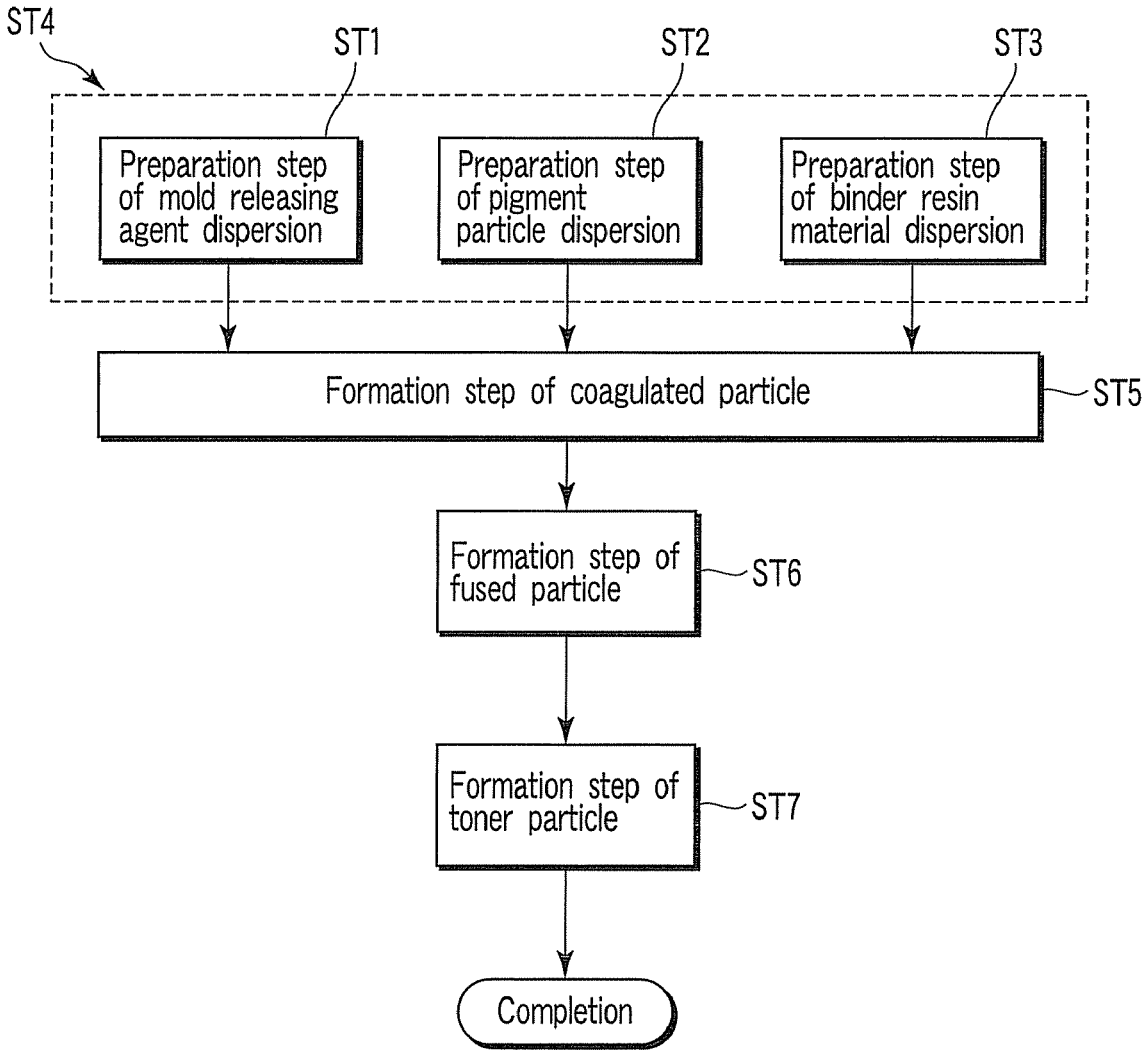
FIG. 1 shows a flow diagram expressing an embodiment of a method for producing a developing agent according to the invention.

FIG. 1 shows a flow diagram expressing an embodiment of a method for producing a developing agent according to the invention.

As illustrated in FIG. 1, this method includes a preliminary step (ST4) including a step of, first of all, preparing a dispersion of a mold releasing agent particle (ST1), a step of preparing a dispersion of a pigment particle (ST2) and a step of preparing a dispersion of a radical polymerizable monomer as a binder resin material (ST3); a step of mixing and heating the respective dispersions of particles obtained in the preliminary step (ST4) to achieve radical polymerization and coagulation, thereby forming a coagulated particle (ST5); a step of fusing the coagulated particle to form a fused particle (ST6); and a step of washing and drying the fused particle to obtain a toner particle (ST7). After the step of obtaining a toner particle (ST7), a step of applying an external agent to a surface of the toner particle can be optionally employed.

According to this method, in the step for forming a coagulated particle (ST5), a reducing agent which is selected from iron(II) sulfate and iron(II) chloride is at least added, and a polymerization initiator can be optionally added.

Also, a polymerization initiator can be added in any one of the steps included in the preliminary step (ST4).

A radical polymerizable monomer which is used as the binder resin material is subjected to emulsion polymerization, soap-free polymerization, seed polymerization, miniemulsion polymerization or the like, whereby a binder resin fine particle can be prepared.

Thereafter, the binder resin fine particle is coagulated with a coloring agent particle and the like, whereby a coagulated particle can be prepared.

Furthermore, a surface of the primary particle may be fused by heating. A dispersion of a mold releasing agent such as a wax can be further mixed in the dispersion of the radical polymerizable monomer.

Also, a polymerizable monomer is subjected to polymerization such as emulsion polymerization, soap-free polymerization, seed polymerization, miniemulsion polymerization and suspension emulsion at least in the presence of a coloring agent, whereby a binder resin fine particle can be obtained, too.

When emulsion polymerization is carried out, the radical polymerizable monomer can be added dropwise after heating the dispersion medium.

This primary particle preferably has a volume average particle size of from 3 μm to 0.1 μm, and more preferably from 1 μm to 0.3 μm. When the volume average particle size exceeds 3 μm, the particle size distribution of the ultimately obtained toner is liable to become broad, whereas when it is less than 0.1 μm, it is difficult to perform the coagulation with the coloring agent.

The particle size of the coagulated particle can be adjusted by performing pH adjustment of the dispersion, heating, addition of a salt, addition of a coagulating agent or the like, thereby relieving or removing repulsion between the particles. The heating can be carried out at a temperature of, for example, 30° C. or higher.

Also, in performing the coagulation, a coagulating agent can be further added as the need arises. As such a coagulating agent, high-molecular weight coagulating agents such as polyacrylamide and acrylamide derivatives; inorganic coagulating agents such as aluminum sulfate, poly(aluminum hydroxide) and poly(aluminum chloride); and salts such as sodium chloride, magnesium chloride, iron sulfate and tin sulfate can be used.

Also, after preparing the coagulated particle, the coagulated particle is fused, whereby a fused particle can be obtained. The fused particle can be obtained by heating a coagulated particle-containing solution at a temperature of Tg of the binder resin or higher or a melting point of the mold releasing agent or higher. However, when encapsulation is carried out, according to the encapsulation method, this fusion step can be carried out along with the encapsulation step, and therefore, the steps can be simplified.

Figure 2:
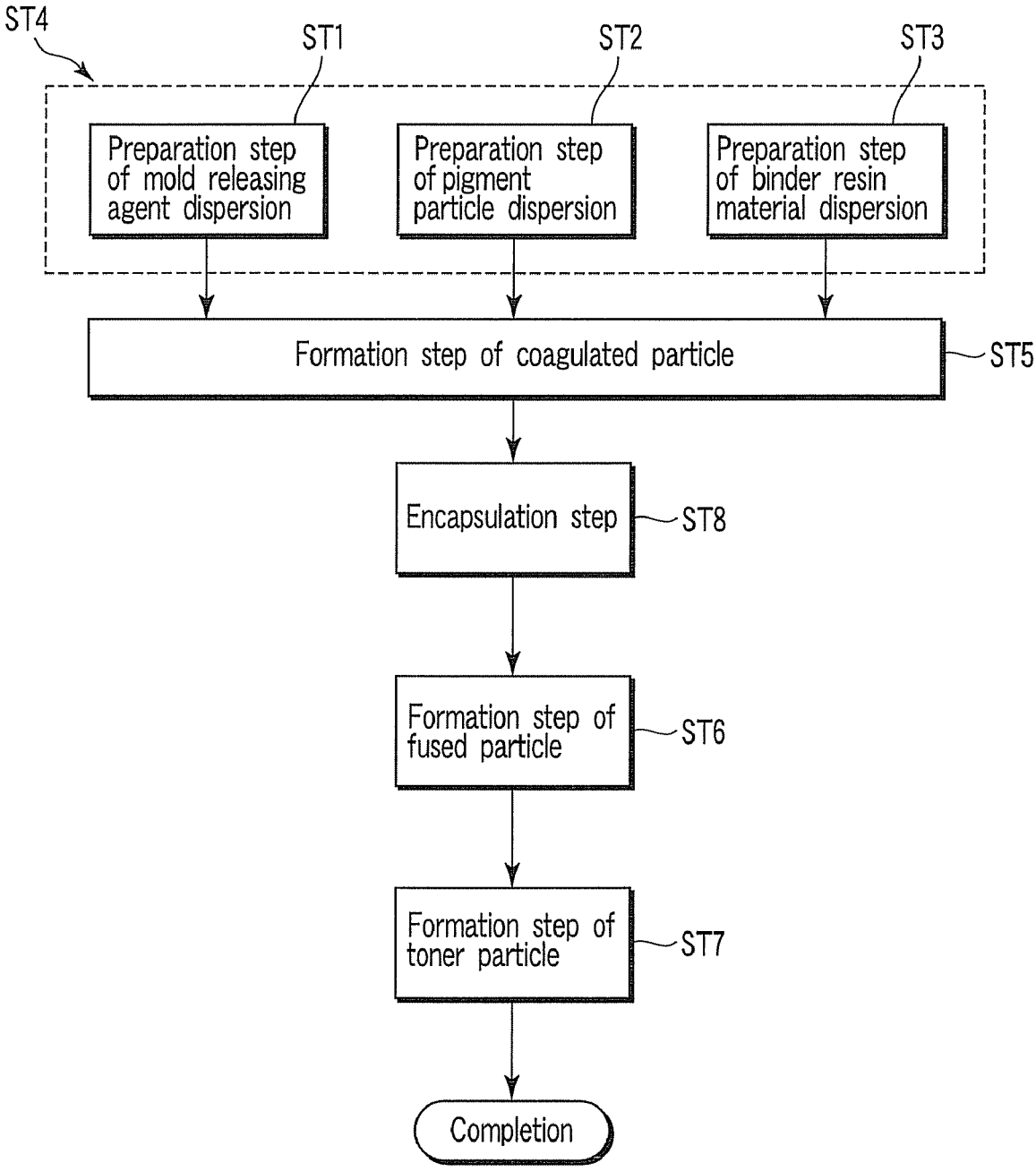
FIG. 2 shows a flow diagram expressing another embodiment of a method for producing a developing agent according to the invention.

FIG. 2 shows a flow diagram expressing another embodiment of a method for producing a developing agent according to the invention.

As illustrated in FIG. 2, this method includes a preliminary step (ST4) including a step of, first of all, preparing a dispersion of a mold releasing agent particle (ST1), a step of preparing a dispersion of a pigment particle (ST2) and a step of preparing a dispersion of a radical polymerizable monomer as a binder resin material (ST3); a step of mixing and heating the respective dispersions of particles obtained in the preliminary step (ST4) to achieve radical polymerization and coagulation, thereby forming a coagulated particle (ST5); a step of encapsulating the coagulated particle (ST8); a step of fusing the encapsulated coagulated particle to form a fused particle (ST6); and a step of washing and drying the fused particle to obtain a toner particle (ST7). After the step of obtaining a toner particle (ST7), a step of applying an external agent to a surface of the toner particle can be optionally employed. This method is substantially the same as in the method as illustrated in FIG. 1, except for the matter that the step of encapsulating the coagulated particle (ST8) is provided before the step of forming a fused particle (ST6).

In the invention, the surface of the coagulated particle can be encapsulated. The encapsulated particle can be obtained by adding a resin particle and the like in the coagulated particle-containing solution, depositing the resin particle and the like on the surface of the coagulated particle and then fusing the resin particle and the like on the surface of the coagulated particle. Also, it is possible to obtain the encapsulated particle by adding a radical polymerizable monomer in the coagulated particle-containing solution to cover or swell the surface of the coagulated particle with the monomer and then polymerizing the monomer. Furthermore, it is possible to achieve encapsulation by, after fusing the coagulated particle, washing and drying the particle and mechanically depositing the resin particle and the like on the surface of the fused particle by using a hybridizer or the like.

When the resin particle is used in this encapsulation, the Tg of this resin particle is desirably 50° C. or higher, and more desirably 55° C. or higher. When the Tg is lower than 50° C., the preservability of the toner is liable to become worse.

By employing the invention, it is possible to shorten the entire production time in the toner production without reducing toner performances such as the amount of the residual monomer. Also, by employing the invention, it is possible to more efficiently perform control of the particle size by coagulation and the encapsulation by hetero-coagulation. In this way, according to the invention, it becomes possible to produce a toner with low cost and low environmental pollution.

As the radical polymerizable monomer which is used in the invention, aromatic vinyl monomers such as styrene, methylstyrene, methoxystyrene, phenylstyrene and chlorostyrene; ester based monomers such as methyl acrylate, ethyl acrylate, butyl acrylate, methyl methacrylate, ethyl methacrylate and butyl methacrylate; carboxylic acid-containing monomers such as acrylic acid, methacrylic acid, fumaric acid and maleic acid; amine based monomers such as amino acrylate, acrylamide, methacrylamide, vinylpyridine and vinylpyrrolidone; and derivatives thereof can be used singly or in admixture of plural kinds thereof.

A chain transfer agent can be further added in the dispersion of the radical polymerizable monomer. Examples of the chain transfer agent which is used include carbon tetrabromide, dodecylmercaptan, trichlorobromomethane, dodecanethiol and 3-mercaptopropionic esters.

A crosslinking agent can be further added in the dispersion of the radical polymerizable monomer. Examples of the crosslinking agent which can be used include compounds having two or more unsaturated bonds such as divinylbenzene, divinyl ether, divinylnaphthalene and diethylene glycol methacrylate.

The polymerization initiator which is used in the invention can be classified into two kinds of a water-soluble initiator and an oil-soluble initiator depending upon the polymerization method. Examples of the water-soluble initiator which can be used include persulfates such as potassium persulfate and ammonium persulfate; azo based compounds such as 2,2-azobis(2-aminopropane); hydrogen peroxide; and benzoyl peroxide. Also, examples of the oil-soluble initiator which can be used include azo based compounds such as azobisisobutyronitrile and azobisdimethylvaleronitrile; and peroxides such as benzoyl peroxide and dichlorobenzoyl peroxide. Also, if desired, a redox based initiator can be used in combination with a reducing agent such as hydrogen sulfites, an iron(II) ion, alcohols, polyamines and vitamin C.

Examples of the dispersant which can be used include anionic surfactants, cationic surfactants and nonionic surfactants.

Examples of the anionic surfactant which can be used include sulfuric acid esters, sulfonates and phosphoric esters; examples of the cationic surfactant which can be used include amine salts and quaternary ammonium salts; and examples of the nonionic surfactant which can be used include polyethylene glycols, alkylphenol ethylene oxide adducts and polyhydric alcohols. These surfactants can be used singly or in combination of plural kinds thereof.

Examples of the binder resin which can be used include polyester resins, polystyrene resins, styrene-acrylate copolymers, epoxy resins and mixtures of several kinds thereof.

Examples of the coloring agent which can be used include carbon black and organic or inorganic pigments or dyes. In particular, acetylene black, furnace black, thermal black, channel black, ketjen black and the like can be used as the carbon black. Also, Fast Yellow G, Benzidine Yellow, Indo Fast Orange, Irgazin Red, Carmine FB, Carmine 6B, Permanent Bordeaux FRR, Pigment Orange R, Lithol Red 2G, Lake Red C, Rhodamine FB, Rhodamine B Lake, Phthalocyanine Blue, Pigment Blue, Brilliant Green B, Phthalocyanine Green, quinacridone and mixtures of several kinds thereof can be used as the pigment or dye.

Examples of the mold releasing agent which can be used include natural waxes such as rice wax and carnauba wax; petroleum waxes such as paraffin wax; and synthetic waxes such as fatty acid esters, fatty acid amides, low-molecular weight polyethylene and low-molecular weight polypropylene.

EXAMPLES

The invention is specifically described below with reference to the following Examples.

Example 1

Preparation of Mold Releasing Agent Particle

Rice wax (melting point: 80° C., manufactured by Toakasei Co., Ltd.): 100 g

Anionic surfactant (manufactured by Dai-ichi Kogyo Seiyaku Co., Ltd.): 10 g

Ion exchanged water: 390 g

The foregoing materials were dispersed while heating at about 90° C. by using a homogenizer (manufactured by IKA Japan K.K.), and the dispersion was processed by using a wet high-pressure emulsification machine to prepare a mold releasing agent particle dispersion having a volume average particle size of 102 nm.

Preparation of Pigment Particle

Carbon black (manufactured by Cabot Corporation): 100 g

Anionic surfactant (manufactured by Dai-ichi Kogyo Seiyaku Co., Ltd.): 10 g

Ion exchanged water: 390 g

The foregoing materials were dispersed by using a homogenizer (manufactured by IKA Japan K.K.) to prepare a coloring agent dispersion having a volume average particle size of 150 nm. The volume average particle size was measured by using a laser diffraction particle size analyzer, SALD-7000, manufactured by Shimadzu Corporation.

Preparation of Resin Particle

Styrene monomer: 300 g

Butyl acrylate: 36.0 g

Acrylic acid: 4.5 g

Dodecanethiol: 13.5 g

The foregoing were mixed to prepare a monomer dispersion, which was then dispersed and emulsified in a solvent of 1.8 g of a nonionic surfactant (manufactured by Sanyo Chemical Industries, Ltd.) and 3 g of an anionic surfactant (manufactured by Dai-ichi Kogyo Seiyaku Co., Ltd.) dissolved in 811.2 g of ion exchanged water; after sealing with nitrogen, when the temperature increased to 75° C., 20 g of a 10% ammonium persulfate solution was added; and thereafter, the monomer dispersion was added dropwise over 3 hours.

The "sealing with nitrogen" as referred to herein means that the inside of a reactor is purged with nitrogen and further isolated from the outside air by flowing a trace amount of nitrogen therethrough by using a three-way cock or the like.

Preparation of Coagulated Particle

Resin particle dispersion: 426 g

Wax particle dispersion: 64 g

Coloring agent dispersion: 64 g

After sealing with nitrogen, the foregoing materials were mixed. 10 g of a 10% ammonium persulfate solution was gently added at 50° C. while adequately stirring, and thereafter, 50 g of a 10% iron(II) sulfate aqueous solution was gently added. The mixture was held at 50° C. for one hour and at 60° C. for one hour while weakly stirring. As a result of measurement by Mutisizer 2, manufactured by BECKMAN COULTER, a coagulated particle having a volume average particle size of 4.9 μm was obtained.

Preparation of Toner Particle by Fusion

The foregoing coagulated particle dispersion was heated at 75° C. while weakly stirring and held for 30 minutes to achieve fusion, thereby obtaining a toner particle.

Preparation of Toner Particle

The foregoing fused particle was repeatedly subjected to washing with ion exchanged water and filtration. After thoroughly removing the moisture, the resulting particle was dried by a vacuum dryer for 10 hours. As a result of measurement by Mutisizer 2, manufactured by BECKMAN COULTER, a toner particle having a volume average particle size of 4.9 μm was obtained.

Also, 3% by weight of silica (manufactured by Nippon Aerosil Co., Ltd.) and 0.5% by weight of titanium oxide (manufactured by Ishihara Sangyo Kaisha, Ltd.) were added based on 100% by weight of this toner particle, and the mixture was externally added by a Henschel mixture (manufactured by Mitsui Mining Co., Ltd.) to obtain a toner.

The obtained toner was applied to a copier, e-STUDIO 3510C, manufactured by Toshiba Corporation and subjected to image formation.

The obtained image was good.

Measurement Method of the Content of Residual Monomer

A sample prepared by charging the obtained toner particle in a sample bottle for headspace sampler, Turbo Matrix 40, manufactured by Perkin Elmer, Inc. was used.

The sample was applied and analyzed by using a gas chromatograph mass analyzer, GCMS-QP2010, manufactured by Shimadzu Corporation as a measurement analyzer. The analysis condition is as follows.

Head space: injecting time, 0.08 minutes, oven temperature, 90° C., needle temperature, 180° C., transfer temperature, 180° C., heat-retaining time, 5 minutes, head space carrier gas pressure, 120 kPa Column: DB WAXETR, film thickness, 0.25 μm; length, 30 m; inside diameter, 0.25 mm Column heating condition: pressure, 92.8 kPa; flow rate, 11.7 mL/min; linear velocity, 46.9 cm/sec; purge flow rate, 10.0 mL/min Column heating step:

| Step | Rate (° C./min) | Temperature (° C.) | Holding time (min) |
|---|---|---|---|
| 01 | — | 35 | 3 |
| 02 | 10 | 250 | 10 |

As a result, the content of the residual styrene monomer in the toner particle was 22 ppm.

Also, the molecular weight of a THF-soluble matter in the toner particle was measured by using Waters' 2695 and 2414, respectively.

As a result, Mw was 22,000, and Mw/Mn was 2.3.

The following Table 1 shows the volume average particle size of the obtained toner particle; the content of the residual styrene monomer; the state of the encapsulated toner particle surface; the presence or absence of use of the redox initiator; the required time for polymerization, coagulation and fusion steps; and the required time for encapsulation step.

Comparative Example 1

Preparation of Mold Releasing Agent Particle

Rice wax (melting point: 80° C., manufactured by Toakasei Co., Ltd.): 100 g

Anionic surfactant (manufactured by Dai-ichi Kogyo Seiyaku Co., Ltd.): 10 g

Ion exchanged water: 390 g

The foregoing materials were dispersed while heating at about 90° C. by using a homogenizer (manufactured by IKA Japan K.K.), and the dispersion was processed by using a wet high-pressure emulsification machine to prepare a mold releasing agent particle dispersion having a volume average particle size of 102 nm.

Preparation of Pigment Particle

Carbon black (manufactured by Cabot Corporation): 100 g

Anionic surfactant (manufactured by Dai-ichi Kogyo Seiyaku Co., Ltd.): 10 g

Ion exchanged water: 390 g

The foregoing materials were dispersed by using a homogenizer (manufactured by IKA Japan K.K.) to prepare a coloring agent dispersion having a volume average particle size of 150 nm.

Preparation of Resin Particle

Styrene monomer: 300 g

Butyl acrylate: 36.0 g

Acrylic acid: 4.5 g

Dodecanethiol: 13.5 g

The foregoing were mixed to prepare a monomer dispersion, which was then dispersed and emulsified in a solvent of 1.8 g of a nonionic surfactant (manufactured by Sanyo Chemical Industries, Ltd.) and 3 g of an anionic surfactant (manufactured by Dai-ichi Kogyo Seiyaku Co., Ltd.) dissolved in 811.2 g of ion exchanged water; after sealing with nitrogen, when the temperature increased to 75° C., 20 g of a 10% ammonium persulfate solution was added; and thereafter, the monomer dispersion was added dropwise over 3 hours.

A primary particle size of the obtained resin particle dispersion was measured by using SALD-7000, manufactured by Shimadzu Corporation. As a result, the volume average particle size was 100 nm.

Preparation of Coagulated Particle

Resin particle dispersion: 426 g

Wax particle dispersion: 64 g

Coloring agent dispersion: 64 g

After sealing with nitrogen, the foregoing materials were mixed. 50 g of a 10% iron(II) sulfate aqueous solution was gently added at 50° C. while adequately stirring. The mixture was held at 50° C. for one hour and at 60° C. for 2.5 hours while weakly stirring. As a result of measurement by Mutisizer 2, manufactured by BECKMAN COULTER, a coagulated particle having a volume average particle size of 1.9 μm was obtained.

Preparation of Fused Particle

The foregoing coagulated particle dispersion was heated at 75° C. while weakly stirring and held for 30 minutes.

Preparation of Toner Particle

The foregoing fused particle was repeatedly subjected to washing with ion exchanged water and filtration. After thoroughly removing the moisture, the resulting particle was dried by a vacuum dryer for 10 hours to obtain a toner particle having a volume average particle size of 1.9 μm.

3% by weight of silica (manufactured by Nippon Aerosil Co., Ltd.) and 0.5% by weight of titanium oxide (manufactured by Ishihara Sangyo Kaisha, Ltd.) were added based on 100% by weight of this toner particle, and the mixture was externally added by a Henschel mixture (manufactured by Mitsui Mining Co., Ltd.) to obtain a toner.

Example 2

Preparation of Mold Releasing Agent Particle

Rice wax (melting point: 80° C., manufactured by Toakasei Co., Ltd.): 100 g

Anionic surfactant (manufactured by Dai-ichi Kogyo Seiyaku Co., Ltd.): 10 g

Ion exchanged water: 390 g

The foregoing materials were dispersed while heating at about 90° C. by using a homogenizer (manufactured by IKA Japan K.K.), and the dispersion was processed by using a wet high-pressure emulsification machine to prepare a mold releasing agent particle dispersion having a volume average particle size of 102 nm.

Preparation of Pigment Particle

Carbon black (manufactured by Cabot Corporation): 100 g

Anionic surfactant (manufactured by Dai-ichi Kogyo Seiyaku Co., Ltd.): 10 g

Ion exchanged water: 390 g

The foregoing materials were dispersed by using a homogenizer (manufactured by IKA Japan K.K.) to prepare a coloring agent dispersion having a volume average particle size of 150 nm.

Preparation of Resin Particle

Styrene monomer: 300 g

Butyl acrylate: 36.0 g

Acrylic acid: 4.5 g

Dodecanethiol: 13.5 g

The foregoing were mixed to prepare a monomer dispersion, which was then dispersed and emulsified in a solvent of 1.8 g of a nonionic surfactant (manufactured by Sanyo Chemical Industries, Ltd.) and 3 g of an anionic surfactant (manufactured by Dai-ichi Kogyo Seiyaku Co., Ltd.) dissolved in 811.2 g of ion exchanged water; after sealing with nitrogen, when the temperature increased to 75° C., 20 g of a 10% potassium persulfate solution was added; and thereafter, the monomer dispersion was added dropwise over 3 hours. A primary particle size of the obtained resin particle dispersion was measured by using SALD-7000, manufactured by Shimadzu Corporation. As a result, the volume average particle size was 100 nm.

Preparation of Coagulated Particle

Resin particle dispersion: 426 g

Wax particle dispersion: 64 g

Coloring agent dispersion: 64 g

After sealing with nitrogen, the foregoing materials were mixed. 10 g of a 10% potassium persulfate solution was added at 50° C. while adequately stirring, and thereafter, 50 g of a 10% iron(II) sulfate aqueous solution was gently added. The mixture was held at 50° C. for one hour and at 60° C. for one hour while weakly stirring. As a result of measurement by Mutisizer 2, manufactured by BECKMAN COULTER, a coagulated particle having a volume average particle size of 5.0 μm was obtained. The solid phase in the dispersion was 20% by weight, respectively.

Preparation of Fused Particle

The foregoing coagulated particle dispersion was heated at 75° C. while weakly stirring and held for 30 minutes to achieve fusion, thereby obtaining a fused particle.

Preparation of Toner Particle

The foregoing fused particle was repeatedly subjected to washing with ion exchanged water and filtration. After thoroughly removing the moisture, the resulting particle was dried by a vacuum dryer for 10 hours to obtain a toner particle having a volume average particle size of 5.0 μm.

3% by weight of silica (manufactured by Nippon Aerosil Co., Ltd.) and 0.5% by weight of titanium oxide (manufactured by Ishihara Sangyo Kaisha, Ltd.) were added based on 100% by weight of this toner particle, and the mixture was externally added by a Henschel mixture (manufactured by Mitsui Mining Co., Ltd.) to obtain a toner.

The image formation was carried out by using the obtained toner in the same manner as in Example 1. As a result, a good image was obtained.

The following Table 1 shows the volume average particle size of the obtained toner particle; the content of the residual styrene monomer; the state of the encapsulated toner particle surface; the presence or absence of use of the redox initiator; the required time for polymerization, coagulation and fusion steps; and the required time for encapsulation step.

Comparative Example 2

Preparation of Mold Releasing Agent Particle

Rice wax (melting point: 80° C., manufactured by Toakasei Co., Ltd.): 100 g

Anionic surfactant (manufactured by Dai-ichi Kogyo Seiyaku Co., Ltd.): 10 g

Ion exchanged water: 390 g

The foregoing materials were dispersed while heating at about 90° C. by using a homogenizer (manufactured by IKA Japan K.K.), and the dispersion was processed by using a wet high-pressure emulsification machine to prepare a mold releasing agent particle dispersion having a volume average particle size of 102 nm.

Preparation of Pigment Particle

Carbon black (manufactured by Cabot Corporation): 100 g

Anionic surfactant (manufactured by Dai-ichi Kogyo Seiyaku Co., Ltd.): 10 g

Ion exchanged water: 390 g

The foregoing materials were dispersed by using a homogenizer (manufactured by IKA Japan K.K.) to prepare a coloring agent dispersion having a volume average particle size of 150 nm.

Preparation of Resin Particle

Styrene monomer: 300 g

Butyl acrylate: 36.0 g

Acrylic acid: 4.5 g

Dodecanethiol: 13.5 g

The foregoing were mixed to prepare a monomer dispersion, which was then dispersed and emulsified in a solvent of 1.8 g of a nonionic surfactant (manufactured by Sanyo Chemical Industries, Ltd.) and 3 g of an anionic surfactant (manufactured by Dai-ichi Kogyo Seiyaku Co., Ltd.) dissolved in 811.2 g of ion exchanged water; after sealing with nitrogen, when the temperature increased to 75° C., 20 g of a 10% potassium persulfate solution was added; and thereafter, the monomer dispersion was added dropwise over 3 hours. A primary particle size of the obtained resin particle dispersion was measured by using SALD-7000, manufactured by Shimadzu Corporation. As a result, the volume average particle size was 100 nm.

Preparation of Coagulated Particle

Resin particle dispersion: 426 g

Wax particle dispersion: 64 g

Coloring agent dispersion: 64 g

After sealing with nitrogen, the foregoing materials were mixed. 50 g of a 10% iron(II) sulfate aqueous solution was gently added at 50° C. while adequately stirring. The mixture was held at 50° C. for one hour and at 60° C. for 2.5 hours while weakly stirring. As a result of measurement by Mutisizer 2, manufactured by BECKMAN COULTER, a coagulated particle having a volume average particle size of 2.1 μm was obtained.

Preparation of Fused Particle

The foregoing coagulated particle dispersion was heated at 75° C. while weakly stirring and held for 30 minutes to achieve fusion, thereby obtaining a fused particle.

Preparation of Toner Particle

The foregoing fused particle was repeatedly subjected to washing with ion exchanged water and filtration. After thoroughly removing the moisture, the resulting particle was dried by a vacuum dryer for 10 hours to obtain a toner particle having a volume average particle size of 2.1 μm.

3% by weight of silica (manufactured by Nippon Aerosil Co., Ltd.) and 0.5% by weight of titanium oxide (manufactured by Ishihara Sangyo Kaisha, Ltd.) were added based on 100% by weight of this toner particle, and the mixture was externally added by a Henschel mixture (manufactured by Mitsui Mining Co., Ltd.) to obtain a toner.

Example 3

Preparation of Mold Releasing Agent Particle

Rice wax (melting point: 80° C., manufactured by Toakasei Co., Ltd.): 100 g

Anionic surfactant (manufactured by Dai-ichi Kogyo Seiyaku Co., Ltd.): 10 g

Ion exchanged water: 390 g

The foregoing materials were dispersed while heating at about 90° C. by using a homogenizer (manufactured by IKA Japan K.K.), and the dispersion was processed by using a wet high-pressure emulsification machine to prepare a mold releasing agent particle dispersion having a volume average particle size of 102 nm.

Preparation of Pigment Particle

Carbon black (manufactured by Cabot Corporation): 100 g

Anionic surfactant (manufactured by Dai-ichi Kogyo Seiyaku Co., Ltd.): 10 g

Ion exchanged water: 390 g

The foregoing materials were dispersed by using a homogenizer (manufactured by IKA Japan K.K.) to prepare a coloring agent dispersion having a volume average particle size of 150 nm.

Preparation of Resin Particle

Styrene monomer: 300 g

Butyl acrylate: 36.0 g

Acrylic acid: 4.5 g

Dodecanethiol: 13.5 g

The foregoing were mixed to prepare a monomer dispersion, which was then dispersed and emulsified in a solvent of 1.8 g of a nonionic surfactant (manufactured by Sanyo Chemical Industries, Ltd.) and 3 g of an anionic surfactant (manufactured by Dai-ichi Kogyo Seiyaku Co., Ltd.) dissolved in 811.2 g of ion exchanged water; after sealing with nitrogen, when the temperature increased to 75° C., 20 g of a 10% sodium persulfate solution was added; and thereafter, the monomer dispersion was added dropwise over 3 hours. A primary particle size of the obtained resin particle dispersion was measured by using SALD-7000, manufactured by Shimadzu Corporation. As a result, the volume average particle size was 100 nm.

Preparation of Coagulated Particle

Resin particle dispersion: 426 g

Wax particle dispersion: 64 g

Coloring agent dispersion: 64 g

After sealing with nitrogen, the foregoing materials were mixed. 10 g of a 10% hydrogen peroxide aqueous solution was gently added at 50° C. while adequately stirring, and thereafter, 50 g of a 10% iron(II) sulfate aqueous solution was gently added. The mixture was held at 50° C. for one hour and at 60° C. for one hour while weakly stirring. As a result of measurement by Mutisizer 2, manufactured by BECKMAN COULTER, a coagulated particle having a volume average particle size of 4.9 μm was obtained.

Preparation of Fused Particle

The foregoing coagulated particle dispersion was heated at 75° C. while weakly stirring and held for 30 minutes to achieve fusion, thereby obtaining a fused particle.

Preparation of Toner Particle

The foregoing fused particle was repeatedly subjected to washing with ion exchanged water and filtration. After thoroughly removing the moisture, the resulting particle was dried by a vacuum dryer for 10 hours to obtain a toner particle having a volume average particle size of 4.9 μm.

3% by weight of silica (manufactured by Nippon Aerosil Co., Ltd.) and 0.5% by weight of titanium oxide (manufactured by Ishihara Sangyo Kaisha, Ltd.) were added based on 100% by weight of this toner particle, and the mixture was externally added by a Henschel mixture (manufactured by Mitsui Mining Co., Ltd.) to obtain a toner having a mold releasing agent content of 15%.

The image formation was carried out by using the obtained toner in the same manner as in Example 1. As a result, a good image was obtained.

The following Table 1 shows the volume average particle size of the obtained toner particle; the content of the residual styrene monomer; the state of the encapsulated toner particle surface; the presence or absence of use of the redox initiator; the required time for polymerization, coagulation and fusion steps; and the required time for encapsulation step.

Comparative Example 3

Preparation of Mold Releasing Agent Particle

Rice wax (melting point: 80° C., manufactured by Toakasei Co., Ltd.): 100 g

Anionic surfactant (manufactured by Dai-ichi Kogyo Seiyaku Co., Ltd.): 10 g

Ion exchanged water: 390 g

The foregoing materials were dispersed while heating at about 90° C. by using a homogenizer (manufactured by IKA Japan K.K.), and the dispersion was processed by using a wet high-pressure emulsification machine to prepare a mold releasing agent particle dispersion having a volume average particle size of 102 nm.

Preparation of Pigment Particle

Carbon black (manufactured by Cabot Corporation): 100 g

Anionic surfactant (manufactured by Dai-ichi Kogyo Seiyaku Co., Ltd.): 10 g

Ion exchanged water: 390 g

The foregoing materials were dispersed by using a homogenizer (manufactured by IKA Japan K.K.) to prepare a coloring agent dispersion having a volume average particle size of 150 nm.

Preparation of Resin Particle

Styrene monomer: 300 g

Butyl acrylate: 36.0 g

Acrylic acid: 4.5 g

Dodecanethiol: 13.5 g

The foregoing were mixed to prepare a monomer dispersion, which was then dispersed and emulsified in a solvent of 1.8 g of a nonionic surfactant (manufactured by Sanyo Chemical Industries, Ltd.) and 3 g of an anionic surfactant (manufactured by Dai-ichi Kogyo Seiyaku Co., Ltd.) dissolved in 811.2 g of ion exchanged water; after sealing with nitrogen, when the temperature increased to 75° C., 20 g of a 10% sodium persulfate solution was added; and thereafter, the monomer dispersion was added dropwise over 3 hours. A primary particle size of the obtained resin particle dispersion was measured by using SALD-7000, manufactured by Shimadzu Corporation. As a result, the volume average particle size was 100 nm.

Preparation of Coagulated Particle

Resin particle dispersion: 426 g

Wax particle dispersion: 64 g

Coloring agent dispersion: 64 g

After sealing with nitrogen, the foregoing materials were mixed. 50 g of a 10% iron(II) sulfate aqueous solution was gently added at 50° C. while adequately stirring. The mixture was held at 50° C. for one hour and at 60° C. for 2.5 hours while weakly stirring. As a result of measurement by Mutisizer 2, manufactured by BECKMAN COULTER, a coagulated particle having a volume average particle size of 1.8 μm was obtained.

Preparation of Fused Particle

The foregoing coagulated particle dispersion was heated at 75° C. while weakly stirring and held for 30 minutes to achieve fusion, thereby obtaining a fused particle.

Preparation of Toner Particle

The foregoing fused particle was repeatedly subjected to washing with ion exchanged water and filtration. After thoroughly removing the moisture, the resulting particle was dried by a vacuum dryer for 10 hours to obtain a toner particle having a volume average particle size of 1.8 μm.

3% by weight of silica (manufactured by Nippon Aerosil Co., Ltd.) and 0.5% by weight of titanium oxide (manufactured by Ishihara Sangyo Kaisha, Ltd.) were added based on 100% by weight of this toner particle, and the mixture was externally added by a Henschel mixture (manufactured by Mitsui Mining Co., Ltd.) to obtain a toner having a mold releasing agent content of 15%.

Example 4

Preparation of Mold Releasing Agent Particle

Rice wax (melting point: 80° C., manufactured by Toakasei Co., Ltd.): 100 g

Anionic surfactant (manufactured by Dai-ichi Kogyo Seiyaku Co., Ltd.): 10 g

Ion exchanged water: 390 g

The foregoing materials were dispersed while heating at about 90° C. by using a homogenizer (manufactured by IKA Japan K.K.), and the dispersion was processed by using a wet high-pressure emulsification machine to prepare a mold releasing agent particle dispersion having a volume average particle size of 102 nm.

Preparation of Pigment Particle

Carbon black (manufactured by Cabot Corporation): 100 g

Anionic surfactant (manufactured by Dai-ichi Kogyo Seiyaku Co., Ltd.): 10 g

Ion exchanged water: 390 g

The foregoing materials were dispersed by using a homogenizer (manufactured by IKA Japan K.K.) to prepare a coloring agent dispersion having a volume average particle size of 150 nm.

Preparation of Resin Particle

Styrene monomer: 300 g

Butyl acrylate: 36.0 g

Acrylic acid: 4.5 g

Dodecanethiol: 13.5 g

The foregoing were mixed to prepare a monomer dispersion, which was then dispersed and emulsified in a solvent of 1.8 g of a nonionic surfactant (manufactured by Sanyo Chemical Industries, Ltd.) and 3 g of an anionic surfactant (manufactured by Dai-ichi Kogyo Seiyaku Co., Ltd.) dissolved in 811.2 g of ion exchanged water; after sealing with nitrogen, when the temperature increased to 75° C., 20 g of a 10% ammonium persulfate solution was added; and thereafter, the monomer dispersion was added dropwise over 3 hours. A primary particle size of the obtained resin particle dispersion was measured by using SALD-7000, manufactured by Shimadzu Corporation. As a result, the volume average particle size was 100 nm. Also, a glass transition point Tg thereof was 60° C.

Preparation of Coagulated Particle

Resin particle dispersion: 426 g

Wax particle dispersion: 64 g

Coloring agent dispersion: 64 g

After sealing with nitrogen, the foregoing materials were mixed. 10 g of a 10% ammonium persulfate solution was added at 50° C. while adequately stirring, and thereafter, 50 g of a 10% iron(II) sulfate aqueous solution was gently added. The mixture was held at 50° C. for one hour and at 60° C. for one hour while weakly stirring. As a result of measurement by Mutisizer 2, manufactured by BECKMAN COULTER, a coagulated particle having a volume average particle size of 5.1 μm was obtained.

Preparation of Encapsulated Particle

Coagulated particle dispersion: 554 g

Resin particle dispersion: 128 g

After sealing with nitrogen, the foregoing materials were mixed. 10 g of 10% aqueous hydrogen peroxide was gently added at 50° C. while adequately stirring. The mixture was held at 50° C. for one hour and at 55° C. for one hour while weakly stirring. As a result of measurement by Mutisizer 2, manufactured by BECKMAN COULTER, a hetero-coagulated particle having a volume average particle size of 5.3 μm was obtained.

Preparation of Fused Particle by Fusion

The foregoing hetero-coagulated particle dispersion was heated at 75° C. while weakly stirring and held for 30 minutes to achieve fusion, thereby obtaining a fused particle.

Preparation of Toner Particle

The foregoing fused particle was allowed to stand, separated from a supernatant and then repeatedly subjected to washing with ion exchanged water and filtration. After thoroughly removing the moisture, the resulting particle was dried by a vacuum dryer for 10 hours to obtain a toner particle having a volume average particle size of 5.3 μm. As a result of observing a cross-section of this toner particle by SEM, a continuous and uniform capsule structure was confirmed.

3% by weight of silica (manufactured by Nippon Aerosil Co., Ltd.) and 0.5% by weight of titanium oxide (manufactured by Ishihara Sangyo Kaisha, Ltd.) were added based on 100% by weight of this toner particle, and the mixture was externally added by a Henschel mixture (manufactured by Mitsui Mining Co., Ltd.) to obtain a toner having a mold releasing agent content of 15%.

The image formation was carried out by using the obtained toner in the same manner as in Example 1. As a result, a good image was obtained.

The following Table 1 shows the volume average particle size of the obtained toner particle; the content of the residual styrene monomer; the state of the encapsulated toner particle surface; the presence or absence of use of the redox initiator; the required time for polymerization, coagulation and fusion steps; and the required time for encapsulation step.

Comparative Example 4

Preparation of Mold Releasing Agent Particle

Rice wax (melting point: 80° C., manufactured by Toakasei Co., Ltd.): 100 g

Anionic surfactant (manufactured by Dai-ichi Kogyo Seiyaku Co., Ltd.): 10 g

Ion exchanged water: 390 g

The foregoing materials were dispersed while heating at about 90° C. by using a homogenizer (manufactured by IKA Japan K.K.), and the dispersion was processed by using a wet high-pressure emulsification machine to prepare a mold releasing agent particle dispersion having a volume average particle size of 102 nm.

Preparation of Pigment Particle

Carbon black (manufactured by Cabot Corporation): 100 g

Anionic surfactant (manufactured by Dai-ichi Kogyo Seiyaku Co., Ltd.): 10 g

Ion exchanged water: 390 g

The foregoing materials were dispersed by using a homogenizer (manufactured by IKA Japan K.K.) to prepare a coloring agent dispersion having a volume average particle size of 150 nm.

Preparation of Resin Particle

Styrene monomer: 300 g

Butyl acrylate: 36.0 g

Acrylic acid: 4.5 g

Dodecanethiol: 13.5 g

The foregoing were mixed to prepare a monomer dispersion, which was then dispersed and emulsified in a solvent of 1.8 g of a nonionic surfactant (manufactured by Sanyo Chemical Industries, Ltd.) and 3 g of an anionic surfactant (manufactured by Dai-ichi Kogyo Seiyaku Co., Ltd.) dissolved in 811.2 g of ion exchanged water; after sealing with nitrogen, when the temperature increased to 75° C., 20 g of a 10% ammonium persulfate solution was added; and thereafter, the monomer dispersion was added dropwise over 3 hours. A primary particle size of the obtained resin particle dispersion was measured by using SALD-7000, manufactured by Shimadzu Corporation. As a result, the volume average particle size was 100 nm.

Preparation of Coagulated Particle

Resin particle dispersion: 426 g

Wax particle dispersion: 64 g

Coloring agent dispersion: 64 g

After sealing with nitrogen, the foregoing materials were mixed. 10 g of a 10% ammonium persulfate solution was added at 50° C. while adequately stirring, and thereafter, 50 g of a 10% iron(II) sulfate aqueous solution was gently added. The mixture was held at 50° C. for one hour and at 60° C. for one hour while weakly stirring. As a result, a coagulated particle having a volume average particle size of 5.1 μm was obtained.

Preparation of Encapsulated Particle

Coagulated particle dispersion: 554 g

Resin particle dispersion: 128 g

After sealing with nitrogen, the foregoing materials were mixed. Under adequate stirring at 50° C., the mixture was held at 50° C. for one hour and at 55° C. for one hour. As a result of measurement by Mutisizer 2, manufactured by BECKMAN COULTER, an encapsulated particle having a volume average particle size of 5.2 μm was obtained.

Preparation of Fused Particle

The foregoing encapsulated particle dispersion was heated at 75° C. while weakly stirring and held for 30 minutes to obtain a fused particle.

Preparation of Toner Particle

The foregoing fused particle was allowed to stand, separated from a supernatant and then repeatedly subjected to washing with ion exchanged water and filtration. After thoroughly removing the moisture, the resulting particle was dried by a vacuum dryer for 10 hours to obtain a toner particle having a volume average particle size of 5.2 μm.

As a result of observing a cross-section of this toner particle by SEM, it was confirmed that the particle was not substantially encapsulated. 3% by weight of silica (manufactured by Nippon Aerosil Co., Ltd.) and 0.5% by weight of titanium oxide (manufactured by Ishihara Sangyo Kaisha, Ltd.) were added based on 100% by weight of this toner particle, and the mixture was externally added by a Henschel mixture (manufactured by Mitsui Mining Co., Ltd.) to obtain a toner having a mold releasing agent content of 15%.

Example 5

Preparation of Resin Particle

Polyester resin (Bisphenol A-terephthalic acid adduct, Tg=61° C., Mw=13,000): 100 g Methylene chloride (manufactured by Wako Pure Chemical Industries, Ltd.): 200 g The foregoing materials were dissolved and dispersed; the dispersion was dispersed in 357 g of ion exchanged water containing 40 g of polyethylene glycol (manufactured by Wako Pure Chemical Industries, Ltd.) and 3 g of an anionic surfactant (manufactured by Dai-ichi Kogyo Seiyaku Co., Ltd.); and an O/W emulsion dispersion was prepared by using a homogenizer (manufactured by IKA Japan K.K.) and then heated at 60° C. to remove the methylene chloride, thereby preparing a resin particle dispersion having a volume average particle size of 500 nm.

Preparation of Mold Releasing Agent Particle

Rice wax (melting point: 80° C., manufactured by Toakasei Co., Ltd.): 100 g

Anionic surfactant (manufactured by Dai-ichi Kogyo Seiyaku Co., Ltd.): 10 g

Ion exchanged water: 390 g

The foregoing materials were dispersed while heating at about 90° C. by using a homogenizer (manufactured by IKA Japan K.K.), and the dispersion was processed by using a wet high-pressure emulsification machine to prepare a mold releasing agent particle dispersion having a volume average particle size of 102 nm.

Preparation of Pigment Particle

Carbon black (manufactured by Cabot Corporation): 100 g

Anionic surfactant (manufactured by Dai-ichi Kogyo Seiyaku Co., Ltd.): 10 g

Ion exchanged water: 390 g

The foregoing materials were dispersed by using a homogenizer (manufactured by IKA Japan K.K.) to prepare a coloring agent dispersion having a volume average particle size of 150 nm.

Preparation of Coagulated Particle

Polyester resin particle dispersion: 382 g

Pigment particle dispersion: 34 g

Mold releasing agent particle dispersion: 73 g

The foregoing materials were uniformly dispersed by using a homogenizer (manufactured by IKA Japan K.K.), 10 g of a 10% aluminum sulfate aqueous solution was additionally added, and the mixture was held at 60° C. for one hour while weakly stirring. There was thus obtained a coagulated particle having a volume average particle size of 5.4 μm.

Preparation of Styrene-Acrylic Resin Particle

Styrene monomer: 300 g

Butyl acrylate: 36.0 g

Acrylic acid: 4.5 g

Dodecanethiol: 13.5 g

The foregoing were mixed to prepare a monomer dispersion, which was then dispersed and emulsified in a solvent of 1.8 g of a nonionic surfactant (manufactured by Sanyo Chemical Industries, Ltd.) and 3 g of an anionic surfactant (manufactured by Dai-ichi Kogyo Seiyaku Co., Ltd.) dissolved in 811.2 g of ion exchanged water; after sealing with nitrogen, when the temperature increased to 75° C., 20 g of a 10% ammonium persulfate solution was added; and thereafter, the monomer dispersion was added dropwise over 3 hours. A primary particle size of the obtained resin particle dispersion was measured by using SALD-7000, manufactured by Shimadzu Corporation. As a result, the volume average particle size was 100 nm.

Preparation of Encapsulated Particle

Coagulated particle dispersion: 554 g

Styrene-acrylic resin particle dispersion: 128 g

After sealing with nitrogen, the foregoing materials were mixed. 10 g of 10% aqueous hydrogen peroxide was gently added at 50° C. while adequately stirring. Under adequate stirring at 50° C., the mixture was held at 50° C. for one hour and at 55° C. for one hour. As a result of measurement by Mutisizer 2, manufactured by BECKMAN COULTER, an encapsulated particle having a volume average particle size of 5.6 μm was obtained.

Preparation of Fused Particle

The foregoing encapsulated particle dispersion was heated at 75° C. while weakly stirring and held for 30 minutes to obtain a fused particle.

Preparation of Toner Particle

The foregoing fused particle was allowed to stand, separated from a supernatant and then repeatedly subjected to washing with ion exchanged water and filtration. After thoroughly removing the moisture, the resulting particle was dried by a vacuum dryer for 10 hours to obtain a toner particle having a volume average particle size of 5.1 μm. As a result of observing a cross-section of this toner particle by SEM, a continuous and uniform capsule structure was confirmed.

3% by weight of silica (manufactured by Nippon Aerosil Co., Ltd.) and 0.5% by weight of titanium oxide (manufactured by Ishihara Sangyo Kaisha, Ltd.) were added based on 100% by weight of this toner particle, and the mixture was externally added by a Henschel mixture (manufactured by Mitsui Mining Co., Ltd.) to obtain a toner having a mold releasing agent content of 15%.

The image formation was carried out by using the obtained toner in the same manner as in Example 1. As a result, a good image was obtained.

The following Table 1 shows the volume average particle size of the obtained toner particle; the content of the residual styrene monomer; the state of the encapsulated toner particle surface; the presence or absence of use of the redox initiator; the required time for polymerization, coagulation and fusion steps; and the required time for encapsulation step.

Comparative Example 5

Preparation of Resin Particle

Polyester resin (Bisphenol A-terephthalic acid adduct, Tg=61° C., Mw=13,000): 100 g Methylene chloride (manufactured by Wako Pure Chemical Industries, Ltd.): 200 g The foregoing materials were dissolved and dispersed; the dispersion was dispersed in 357 g of ion exchanged water containing 40 g of polyethylene glycol (manufactured by Wako Pure Chemical Industries, Ltd.) and 3 g of an anionic surfactant (manufactured by Dai-ichi Kogyo Seiyaku Co., Ltd.); and an O/W emulsion dispersion was prepared by using a homogenizer (manufactured by IKA Japan K.K.) and then heated at 60° C. to remove the methylene chloride, thereby preparing a resin particle dispersion having a volume average particle size of 500 nm.

Preparation of Mold Releasing Agent Particle

Rice wax (melting point: 80° C., manufactured by Toakasei Co., Ltd.): 100 g

Anionic surfactant (manufactured by Dai-ichi Kogyo Seiyaku Co., Ltd.): 10 g

Ion exchanged water: 390 g

The foregoing materials were dispersed while heating at about 90° C. by using a homogenizer (manufactured by IKA Japan K.K.), and the dispersion was processed by using a wet high-pressure emulsification machine to prepare a mold releasing agent particle dispersion having a volume average particle size of 102 nm.

Preparation of Pigment Particle

Carbon black (manufactured by Cabot Corporation): 100 g

Anionic surfactant (manufactured by Dai-ichi Kogyo Seiyaku Co., Ltd.): 10 g

Ion exchanged water: 390 g

The foregoing materials were dispersed by using a homogenizer (manufactured by IKA Japan K.K.) to prepare a coloring agent dispersion having a volume average particle size of 150 nm.

Preparation of Coagulated Particle

Polyester resin particle dispersion: 382 g

Coloring agent dispersion: 34 g

Mold releasing agent particle dispersion: 73 g

The foregoing materials were uniformly dispersed by using a homogenizer (manufactured by IKA Japan K.K.), 10 g of ion exchange water containing aluminum sulfate was additionally added, and the mixture was held at 50° C. for one hour while weakly stirring. As a result of measurement by Mutisizer 2, manufactured by BECKMAN COULTER, a coagulated particle having a volume average particle size of 5.4 μm was obtained.

Preparation of Styrene-Acrylic Resin Particle

Styrene monomer: 300 g

Butyl acrylate: 36.0 g

Acrylic acid: 4.5 g

Dodecanethiol: 13.5 g

The foregoing were mixed to prepare a monomer dispersion, which was then dispersed and emulsified in a solvent of 1.8 g of a nonionic surfactant (manufactured by Sanyo Chemical Industries, Ltd.) and 3 g of an anionic surfactant (manufactured by Dai-ichi Kogyo Seiyaku Co., Ltd.) dissolved in 811.2 g of ion exchanged water; after sealing with nitrogen, when the temperature increased to 75° C., 20 g of a 10% ammonium persulfate solution was added; and thereafter, the monomer dispersion was added dropwise over 3 hours. A primary particle size of the obtained resin particle dispersion was measured by using SALD-7000, manufactured by Shimadzu Corporation. As a result, the volume average particle size was 100 nm.

Preparation of Encapsulated Particle

Coagulated particle dispersion: 554 g

Styrene-acrylic resin particle dispersion: 128 g

After sealing with nitrogen, the foregoing materials were mixed. Under adequate stirring at 50° C., the mixture was held at 50° C. for one hour and at 55° C. for one hour. As a result, an encapsulated particle having a volume average particle size of 5.5 μm was obtained.

Preparation of Fused Particle

The foregoing encapsulated particle dispersion was heated at 75° C. while weakly stirring and held for 30 minutes to obtain a fused particle.

Preparation of Toner Particle

The foregoing fused particle was allowed to stand, separated from a supernatant and then repeatedly subjected to washing with ion exchanged water and filtration. After thoroughly removing the moisture, the resulting particle was dried by a vacuum dryer for 10 hours to obtain a toner particle having a volume average particle size of 5.5 μm. As a result of observing a cross-section of this toner particle by SEM, a heterogeneous capsule structure was confirmed.

3% by weight of silica (manufactured by Nippon Aerosil Co., Ltd.) and 0.5% by weight of titanium oxide (manufactured by Ishihara Sangyo Kaisha, Ltd.) were added based on 100% by weight of this toner particle, and the mixture was externally added by a Henschel mixture (manufactured by Mitsui Mining Co., Ltd.) to obtain a toner having a mold releasing agent content of 15%.

Example 6

Preparation of Mold Releasing Agent Particle

Rice wax (melting point: 80° C., manufactured by Toakasei Co., Ltd.): 100 g

Anionic surfactant (manufactured by Dai-ichi Kogyo Seiyaku Co., Ltd.): 10 g

Ion exchanged water: 390 g

The foregoing materials were dispersed while heating at about 90° C. by using a homogenizer (manufactured by IKA Japan K.K.), and the dispersion was processed by using a wet high-pressure emulsification machine to prepare a mold releasing agent particle dispersion having a volume average particle size of 102 nm.

Preparation of Pigment Particle

Carbon black (manufactured by Cabot Corporation): 100 g

Anionic surfactant (manufactured by Dai-ichi Kogyo Seiyaku Co., Ltd.): 10 g

Ion exchanged water: 390 g

The foregoing materials were dispersed by using a homogenizer (manufactured by IKA Japan K.K.) to prepare a coloring agent dispersion having a volume average particle size of 150 nm.

Preparation of Resin Particle

Styrene monomer: 300 g

Butyl acrylate: 36.0 g

Acrylic acid: 4.5 g

Dodecanethiol: 13.5 g

The foregoing were mixed to prepare a monomer dispersion, which was then dispersed and emulsified in a solvent of 1.8 g of a nonionic surfactant (manufactured by Sanyo Chemical Industries, Ltd.) and 3 g of an anionic surfactant (manufactured by Dai-ichi Kogyo Seiyaku Co., Ltd.) dissolved in 811.2 g of ion exchanged water; after sealing with nitrogen, when the temperature increased to 75° C., 20 g of a 10% ammonium persulfate solution was added; and thereafter, the monomer dispersion was added dropwise over 3 hours. A primary particle size of the obtained resin particle dispersion was measured by using SALD-7000, manufactured by Shimadzu Corporation. As a result, the volume average particle size was 100 nm.

Preparation of Coagulated Particle

Resin particle dispersion: 426 g

Wax particle dispersion: 64 g

Coloring agent dispersion: 64 g

After sealing with nitrogen, the foregoing materials were mixed. 10 g of a 10% ammonium persulfate solution was added at 50° C. while adequately stirring, and thereafter, 15 g of a 10% iron(II) sulfate aqueous solution was gently added. Furthermore, 35 g of a 10% aluminum sulfate aqueous solution was gently added. The mixture was held at 50° C. for 30 minutes, at 60° C. for 30 minutes and at 70° C. for one hour while weakly stirring. As a result of measurement by Mutisizer 2, manufactured by BECKMAN COULTER, a coagulated particle having a volume average particle size of 5.1 μm was obtained.

Preparation of Fused Particle

The foregoing coagulated particle dispersion was heated at 75° C. while weakly stirring and held for 30 minutes to obtain a fused particle.

Preparation of Toner Particle

The foregoing fused particle was repeatedly subjected to washing with ion exchanged water and filtration. After thoroughly removing the moisture, the resulting particle was dried by a vacuum dryer for 10 hours to obtain a toner particle having a volume average particle size of 5.1 μm.

3% by weight of silica (manufactured by Nippon Aerosil Co., Ltd.) and 0.5% by weight of titanium oxide (manufactured by Ishihara Sangyo Kaisha, Ltd.) were added based on 100% by weight of this toner particle, and the mixture was externally added by a Henschel mixture (manufactured by Mitsui Mining Co., Ltd.) to obtain a toner having a mold releasing agent content of 15%.

The image formation was carried out by using the obtained toner in the same manner as in Example 1. As a result, a good image was obtained.

The following Table 1 shows the volume average particle size of the obtained toner particle; the content of the residual styrene monomer; the state of the encapsulated toner particle surface; the presence or absence of use of the redox initiator; the required time for polymerization, coagulation and fusion steps; and the required time for encapsulation step.

Comparative Example 6

Preparation of Mold Releasing Agent Particle

Rice wax (melting point: 80° C., manufactured by Toakasei Co., Ltd.): 100 g

Anionic surfactant (manufactured by Dai-ichi Kogyo Seiyaku Co., Ltd.): 10 g

Ion exchanged water: 390 g

The foregoing materials were dispersed while heating at about 90° C. by using a homogenizer (manufactured by IKA Japan K.K.), and the dispersion was processed by using a wet high-pressure emulsification machine to prepare a mold releasing agent particle dispersion having a volume average particle size of 102 nm.

Preparation of Pigment Particle

Carbon black (manufactured by Cabot Corporation): 100 g

Anionic surfactant (manufactured by Dai-ichi Kogyo Seiyaku Co., Ltd.): 10 g

Ion exchanged water: 390 g

The foregoing materials were dispersed by using a homogenizer (manufactured by IKA Japan K.K.) to prepare a coloring agent dispersion having a volume average particle size of 150 nm.

Preparation of Resin Particle

Styrene monomer: 300 g

Butyl acrylate: 36.0 g

Acrylic acid: 4.5 g

Dodecanethiol: 13.5 g

The foregoing were mixed to prepare a monomer dispersion, which was then dispersed and emulsified in a solvent of 1.8 g of a nonionic surfactant (manufactured by Sanyo Chemical Industries, Ltd.) and 3 g of an anionic surfactant (manufactured by Dai-ichi Kogyo Seiyaku Co., Ltd.) dissolved in 811.2 g of ion exchanged water; after sealing with nitrogen, when the temperature increased to 75° C., 20 g of a 10% ammonium persulfate solution was added; and thereafter, the monomer dispersion was added dropwise over 3 hours. A primary particle size of the obtained resin particle dispersion was measured by using SALD-7000, manufactured by Shimadzu Corporation. As a result, the volume average particle size was 100 nm.

Preparation of Coagulated Particle

Resin particle dispersion: 426 g

Wax particle dispersion: 64 g

Coloring agent dispersion: 64 g

After sealing with nitrogen, the foregoing materials were mixed. 35 g of a 10% aluminum sulfate solution was gently added at 50° C. while adequately stirring. The mixture was held at 50° C. for one hour and at 60° C. for 2.5 hours while weakly stirring. As a result, a coagulated particle having a volume average particle size of 2.8 μm was obtained.

Preparation of Fused Particle

The foregoing coagulated particle dispersion was heated at 75° C. while weakly stirring and held for 30 minutes to obtain a fused particle.

Preparation of Toner Particle

The foregoing fused particle was repeatedly subjected to washing with ion exchanged water and filtration. After thoroughly removing the moisture, the resulting particle was dried by a vacuum dryer for 10 hours to obtain a toner particle having a volume average particle size of 2.8 μm.

3% by weight of silica (manufactured by Nippon Aerosil Co., Ltd.) and 0.5% by weight of titanium oxide (manufactured by Ishihara Sangyo Kaisha, Ltd.) were added based on 100% by weight of this toner particle, and the mixture was externally added by a Henschel mixture (manufactured by Mitsui Mining Co., Ltd.) to obtain a toner having a mold releasing agent content of 15%.

TABLE 1

| | Volume average particle size of coagulated particle (μm) | Content of residual monomer (ppm) | Encapsulation state (Observation of cross-section by SEM) | Use of redox initiator | Resin synthesis, coagulation and fusion steps (hr) | Encapsulation step (hr) |
|---|---|---|---|---|---|---|
| Example 1 | 4.9 | 22 | — | Yes | 5.5 | 0 |
| Example 2 | 5.0 | 18 | — | Yes | 5.5 | 0 |
| Example 3 | 4.9 | 25 | — | Yes | 5.5 | 0 |
| Example 4 | 5.1 (5.3 after encapsulation) | 41 | Uniform | Yes | 5.5 | 2.0 |
| Example 5 | 5.4 (5.6 after encapsulation) | 17 | Uniform | Yes | 1.5 (not including resin synthesis step) | 2.0 |
| Example 6 | 5.1 | 22 | — | Yes | 5.5 | 0 |
| Comparative Example 1 | 1.9 | 462 | — | No | 7.0 | 0 |
| Comparative Example 2 | 2.1 | 377 | — | No | 7.0 | 0 |
| Comparative Example 3 | 1.8 | 296 | — | No | 7.0 | 0 |
| Comparative Example 4 | 5.1 (5.2 after encapsulation) | 776 | Heterogeneous | No (encapsulation step) | 5.5 | 2.0 |

TABLE 1-continued

| | Volume average particle size of coagulated particle (μm) | Content of residual monomer (ppm) | Encapsulation state (Observation of cross-section by SEM) | Use of redox initiator | Resin synthesis, coagulation and fusion steps (hr) | Encapsulation step (hr) |
|---|---|---|---|---|---|---|
| Comparative Example 5 | 5.4 (5.5 after encapsulation) | 191 | Heterogeneous | No (encapsulation step) | 1.5 (not including resin synthesis step) | 2.0 |
| Comparative Example 6 | 2.8 | 402 | — | No | 7.0 | 0 |

Durability Evaluation

Also, the copier, e-STUDIO 3510C, manufactured by Toshiba Corporation was set up such that a fixed deposition amount of the toner was always placed on paper, and a durability test of continuous paper-passing with 50,000 sheets was performed by using a test chart with a printing rate of 8% and by using each of the toners of Examples 1 to 6 and Comparative Examples 1 to 6. In this test, a wholly solid image was outputted at every 5,000 sheets, and the presence or absence of an image defect due to filming was confirmed.

With respect to the presence or absence of an image defect due to filming, Examples 1 to 6 exhibited satisfactory results in substantially the same manner. In Comparative Examples 4 and 5, an image defect due to filming was confirmed. It is thought that this was caused due to the generation of sticking by the residual monomer. Also, a monomer odor was confirmed from the instrument and the material to be transferred.

In Comparative Examples 1, 2, 3 and 6, conveyance failure was generated so that the durability evaluation could not be performed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for producing a developing agent comprises:

applying a radical polymerizable monomer as a binder resin material in a dispersion medium containing a dispersant selected from the group consisting of an anionic surfactant, a nonionic surfactant and a cationic surfactant and a polymerization initiator to prepare a dispersion of the radical polymerizable monomer;

mixing a dispersion containing a coloring agent particle with the dispersion of the radical polymerizable monomer to form a mixture, and adding a reducing agent selected from iron(II) sulfate and iron(II) chloride to the mixture to polymerize the dispersed radical polymerizable monomer by the action of a generated radical, thereby not only forming a binder resin fine particle but coagulating the binder resin fine particle and the coloring agent particle to form a coagulated particle.

2. The method for producing a developing agent according to claim 1, wherein the radical polymerizable monomer is added dropwise after heating the dispersion medium to a temperature at which the polymerization is initiated.

3. The method for producing a developing agent according to claim 1, further comprising, after forming a coagulated particle, heating the coagulated particle-containing dispersion to a temperature at which the polymerization is initiated while stirring, thereby fusing with the coagulated particle.

4. The method for producing a developing agent according to claim 1, wherein the polymerization initiator is at least one member selected from the group consisting of potassium persulfate, ammonium persulfate, 2,2-azobis(2-aminopropane), hydrogen peroxide, benzoyl peroxide, azobisisobutyronitrile, azobisdimethylvaleronitrile, benzoyl peroxide and dichlorobenzoyl peroxide.

5. The method for producing a developing agent according to claim 1, wherein the radical polymerizable monomer is at least one member selected from the group consisting of styrene, methylstyrene, methoxystyrene, phenylstyrene, chlorostyrene, methyl acrylate, ethyl acrylate, butyl acrylate, methyl methacrylate, ethyl methacrylate, butyl methacrylate, acrylic acid, methacrylic acid, fumaric acid, maleic acid, amino acrylate, acrylamide, methacrylamide, vinylpyridine, vinylpyrrolidone and derivatives thereof.

6. The method for producing a developing agent according to claim 1, further comprising, after forming a coagulated particle, providing a resin layer on a surface of the coagulated particle to form an encapsulated particle.

7. The method for producing a developing agent according to claim 1, where in a wax dispersion is further mixed in the dispersion of the radical polymerizable monomer.

* * * * *